US007255631B2

(12) United States Patent
Rhoades

(10) Patent No.: US 7,255,631 B2
(45) Date of Patent: Aug. 14, 2007

(54) ORBITAL POLISHING APPARATUS AND METHOD

(75) Inventor: Lawrence J. Rhoades, Naples, FL (US)

(73) Assignee: Extrude Hone Corporation, Irwin, PA (US)

( * ) Notice: Subject to any disclaimer, the term of this patent is extended or adjusted under 35 U.S.C. 154(b) by 0 days.

(21) Appl. No.: 11/365,755

(22) Filed: Mar. 1, 2006

(65) Prior Publication Data

US 2006/0229003 A1 Oct. 12, 2006

Related U.S. Application Data

(60) Provisional application No. 60/657,898, filed on Mar. 2, 2005.

(51) Int. Cl.
*B24B 31/00* (2006.01)

(52) U.S. Cl. ..... 451/36; 451/60; 451/113; 451/385

(58) Field of Classification Search ..... 451/36, 451/37, 38, 39, 40, 51, 57, 60, 65, 332, 385, 451/386, 61, 112, 113
See application file for complete search history.

(56) References Cited

U.S. PATENT DOCUMENTS 6,152,805 A * 11/2000 Takahashi ..... 451/36
6,390,903 B1 * 5/2002 Takahashi et al. ..... 451/286
2004/0209554 A1 * 10/2004 Tsumagari et al. ..... 451/36

* cited by examiner

*Primary Examiner*—Jacob K. Ackun, Jr.

(57) ABSTRACT

An abrasive flow apparatus for polishing a workpiece wherein a horizontal machine tool is adapted such that a workpiece may be secured to first shaft rotatable about a first longitudinal axis. A conjugate form to the workpiece may be secured to a second shaft which is rotatable about a second longitudinal axis. The workpiece and conjugate form are secured to each shaft in a manner such that they are facing one another and slightly set apart to define a gap. A flowable abrasive media is introduced within this gap. The centerlines of the workpiece and the conjugate form are offset from one another such that rotation of the shafts in the same direction and at the same rotational speed produces relative motion between the workpiece and the conjugate form thereby polishing the workpiece. A slide may be used for axially positioning the first shaft and the second shaft a predetermined distance to define the size of the gap. A feeder may be used for introducing flowable abrasive media within a work zone defined by the volume of the gap between the workpiece and the conjugal form.

20 Claims, 3 Drawing Sheets

ORBITAL POLISHING APPARATUS AND METHOD

CROSS-REFERENCE TO RELATED APPLICATIONS

This application claims the benefit of U.S. Provisional Application No. 60/657,898 filed Mar. 2, 2005.

BACKGROUND OF THE INVENTION

1. Field of the Invention

This invention relates to orbital polishing and more particularly to an apparatus and method for polishing a workpiece utilizing an orbital polishing machine with a flowable elastic abrasive media.

2. Description of Related Art

Abrasive flow machining is a well known non-traditional machining process whereby a visco-elastic media permeated with an abrasive grit is extruded through or past a workpiece surface to abrade surfaces over which the media passes. The abrasive action and abrasive flow machining can be thought of as analogous to a filing, grinding, lapping or honing operation where the extruded visco-elastic abrasive media passes through or past the workpiece as a "plug." The plug then becomes a self-forming file, grinding stone or lap as it is extruded under pressure through or past the workpiece, thereby abrasively working upon selected surfaces of the workpiece. The special properties of the visco-elastic media are such that the material will become most aggressive at its greatest restriction.

Recently, this technology has been utilized with orbital polishing to create a hybrid technology. Orbital polishing uses much of the same technology as abrasive flow machining, but utilizes a mechanical motion to polish three-dimensional forms not possible to be polished by the conventional abrasive flow machining technique. While traditional abrasive flow machining requires flow of abrasive media over or through the workpiece, such flow may or may not be used with the orbital polishing process, since motion is imparted to the abrasive media by the orbital polishing machine independent of any abrasive media flow. Details of an orbital polishing machine may be found in U.S. Pat. No. 4,891,916, assigned to Extrude Hone Corporation, the assignee of the present invention and the contents of this patent are herein incorporated by reference.

The flowable abrasive media may be a flowable, visco-elastic polymer with abrasive particles mixed therein. The polymer and abrasives selected for a given polishing operation are determined in part by the material to be polished and the polish finish desired. Typical abrasives include silicon carbide, aluminum oxide and boron carbide. The use of such media for metalworking operations is described in detail in U.S. Pat. No. 6,273,787, assigned to Extrude Hlone Corporation, the assignee of the present invention and the contents of this patent are hereby incorporated by reference.

One area of manufacturing in which orbital polishing has been used only to a limited amount is for the polishing of motor vehicle wheels. Many of these wheels have decorative, highly polished shapes which are very difficult to polish into a finished product. Manufacturers of after-market motor vehicle wheels are presently limited in their production volumes due to limitations required by polishing such wheels and the existence of few facilities capable of supporting the industry. The current production volumes of a given wheel range from hundreds of sets to thousands of sets per month. Typically, these wheels are polished by hand, although some other semi-automated process, such as a buffing process, may be used as well. Hand polishing generates high demands on the existing labor force and the semi-automatic process generates high demands on existing equipment. Current equipment and processes also generate high amounts of air-borne pollutants. The demand for such polished wheels currently exceeds the supply by up to 30% since such production increases have not been possible because of lack of equipment and a process to polish cast wheels in a more timely and cost effective manner.

Whenever the wheels are polished by hand, the finish of such a polishing effort is dependent on the skill of the individual person and, as a result, each wheel will have a variance from the next wheel for a given size. Another prior art polishing process involves a shot peening process where a media is forced into contact with a wheel and the wheel is set in motion in an effort to polish it. In other mechanical processes, buffing and/or brushing are utilized. The shot peening process does not produce the desired highly polished surface. With the buffing process, the complexity of some of the wheels is such that the buffing wheels do not extend into the intricate pattern of the face of the wheel. The buffing wheel will only reach limited areas of the wheel, thereby requiring the use of hand finishing to achieve the final luster. Nevertheless, it is impossible to create a consistently "leveled" surface finish on a wheel with any current process.

In general, prior polishing systems have failed to achieve the desired cycle times with the desired efficiency. Furthermore, the size and operational dynamics of a traditional abrasive flow machine for polishing wheels larger than 20 inches in diameter, such as wheels for over-the-road vehicles, makes the use of existing AFM techniques impractical, since such techniques are intended for much smaller workpieces.

SUMMARY OF THE INVENTION

The subject invention is directed to an abrasive flow apparatus for polishing a workpiece. The apparatus is comprised of a first shaft secured to a base and rotatable about a first longitudinal axis. The first shaft has a first end adapted to receive a workpiece having a centerline. The apparatus also has a second shaft secured to the base and rotatable about a second longitudinal axis. The second shaft has a first end adapted to receive a conjugate form of the workpiece. The conjugate form also has a centerline. The first ends of the shafts are facing one another such that the workpiece and conjugate form are facing one another. The centerline of the workpiece and the centerline of the conjugal form are displaced from one another to define an offset. The apparatus furthermore has a slide for axially positioning the first shaft and the second shaft a predetermined distance from one another such that the workpiece on the first shaft may be positioned adjacent to the conjugate form on the second shaft with a gap defined therebetween. The apparatus furthermore has a feeder for introducing flowable visco-elastic abrasive media within a work zone defined by the volume of the gap between the workpiece and the conjugal form. A driver rotates the first shaft and the second shaft simultaneously such that their first ends are rotating in the same direction and wherein the offset between the two shafts creates relative motion between the workpiece and conjugate form such that the flowable abrasive media is urged against the workpiece by the conjugate form.

The subject invention is also directed to a method for polishing workpieces comprising the steps of:

a) mounting a workpiece upon a first end of a first shaft on a horizontal bed, such as a lathe, wherein the first shaft has a longitudinal axis;

b) mounting a conjugate form to the workpiece upon a first end of a second shaft on the horizontal lathe, wherein the second shaft has a horizontal axis and opposes the first shaft;

c) positioning the workpiece and the conjugate form relative to and facing one another such that a small gap exists between them;

d) introducing abrasive flowable media within the gap between the workpiece and the conjugate form; and e) imparting cyclical offset relative motion between the workpiece and the conjugate form such that the abrasive flowable media is urged by the conjugate form against the workpiece, thereby polishing the workpiece.

DETAILED DESCRIPTION OF THE INVENTION

Figure 1:
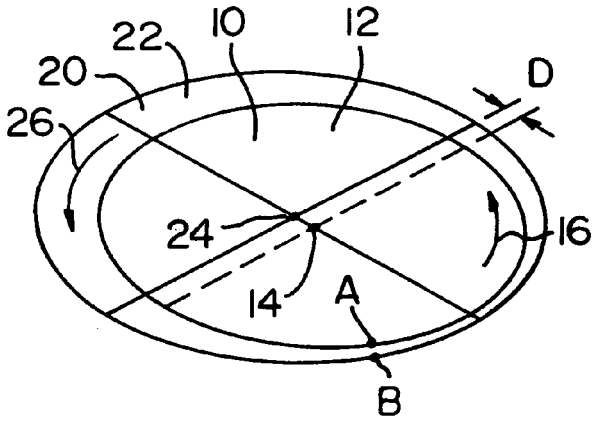
FIGS. 1 and 2 are sketches which illustrate graphically the concept of orbital polishing.
Figure 2:
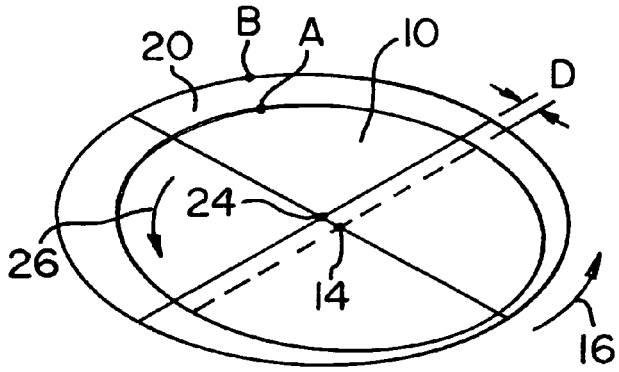

FIGS. 1 and 2 show schematically the motion associated with the orbital polishing method. For discussion, a workpiece 10 will be represented as disk 12, while the conjugate form 20 of the workpiece 10 will be represented by circle 22. The workpiece 10 rotates about center 14 in the direction of arrow 16, while the conjugate form 20 rotates about center 24 in the direction of arrow 26. It is significant that the center 14 of the workpiece 10 is offset from the center 24 of the conjugate form 26 by offset distance D. When both the workpiece 10 and the conjugate form 20 rotate in the same direction at the same rotational speed then there is relative motion between the workpiece 10 and the conjugate form 20. The distance of the offset D between the workpiece 10 and the conjugate part 20 may be a distance of between 0.5 and 5.0 millimeters.

As an example, in FIG. 1, Point A on the workpiece 10 is directly adjacent to point B on the conjugate form 20. As the workpiece 10 and the conjugate form 20 rotate in the directions indicated by arrows 16, 26, then when each has traveled approximately 180°, as illustrated in FIG. 2, point A and point B are distant from one another. To the extent that the workpiece 10 and the conjugate form 20 would be in direct contact with each other, then as flat disks, they would merely rub against each other. It is this general motion, which is the basic motion upon which orbital polishing is based. Orbital polishing accommodates three-dimensional workpieces by forcing flowable abrasive media under pressure between the workpiece 10 and the conjugate form 20.

The conjugate form 20 of the workpiece 10 is a form having a mating image of one side of the workpiece 10. As an example, if one side of the workpiece 10 were to be covered with molding clay, the conjugate form 20 would be a part having the shape of the clay against a side of the workpiece 10 but slightly smaller because it will be used in an orbital polishing operation upon the workpiece 10. In other words, the conjugate form is a form having the same geometry as the workpiece but in reverse relationship and on a slightly smaller scale. In such a fashion, flowable abrasive media may be introduced between the workpiece 10 and the conjugate form 20, whereby the relative rotation between these two parts causes the flowable abrasive media to polish the workpiece.

Figure 3:
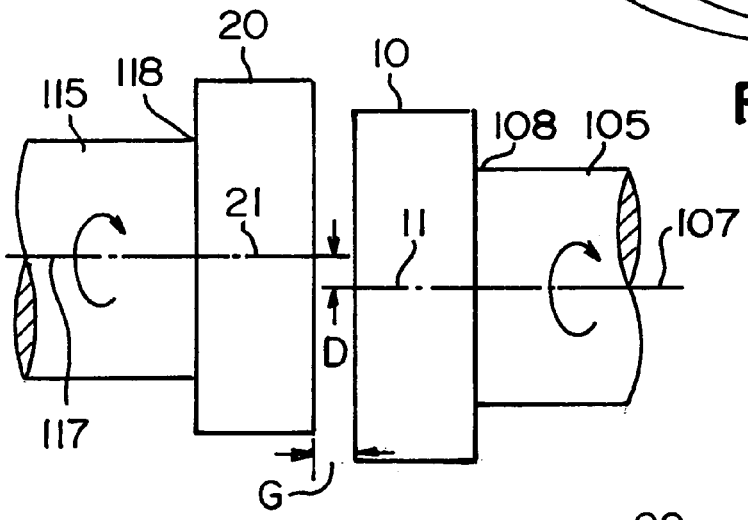
FIGS. 3 and 4 are sketches which illustrate the arrangements by which an offset is provided between the workpiece and the conjugate form.
Figure 4:
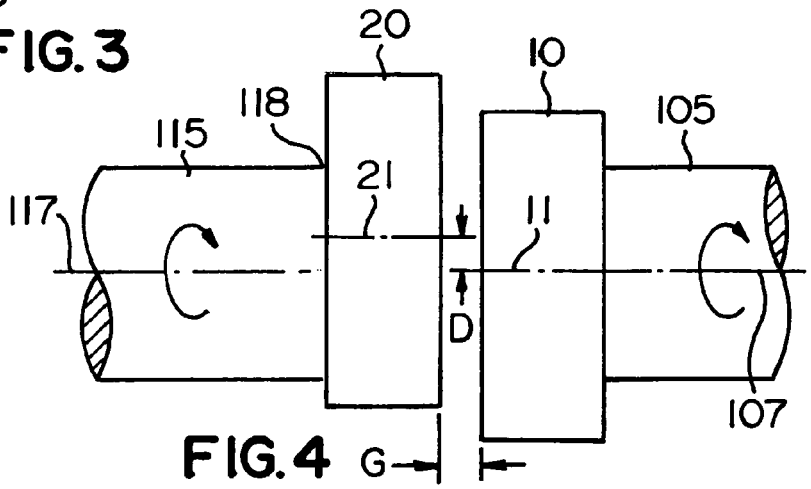

FIGS. 3 and 4 are schematics illustrating design features which make possible the orbital polishing motion just described.

Directing attention to FIG. 3, a first shaft 105 is rotatable about a first longitudinal axis 107, wherein the first shaft 105 has a first end 108 adapted to receive a workpiece 10 having a centerline 11. A second shaft 115 is rotatable about a second longitudinal axis 117. The second shaft 115 has a first end 118 adapted to receive the conjugate form 20 of the workpiece 10. The conjugate form 20 has a centerline 21. The first ends 108, 118 of the shafts 105, 115 face each other such that the workpiece 10 and the conjugate form 20 are facing one another.

In FIG. 3, the centerline 11 of the workpiece 10 is co-axial with the first longitudinal axis 107 of the first shaft 105. Furthermore, the centerline 21 of the conjugate form 20 is coaxial with the second longitudinal axis 117 of the second shaft 115. However, the first longitudinal axis 107 and the second longitudinal axis 117 are offset relative to one another by an offset D such that rotation of the first shaft 105 and rotation of the second shaft 115 in the same direction and at the same rotational speed will produce orbital motion between the workpiece 10 and the conjugate form 20. In this embodiment, the offset D is formed between the first longitudinal axis 107 and the second longitudinal axis 117.

Directing attention to FIG. 4, the same reference numerals as those used in FIG. 3 are used again. However, in this arrangement the first longitudinal axis 107 of the first shaft 105 is co-axial with the second longitudinal axis 117 of the second shaft 115. However, the conjugate form 20 is mounted upon the first end 118 of the second shaft 115 in an offset fashion such that the centerline 21 defines an offset D with respect to the centerline 11 of the workpiece 10. Once again, rotation of the first shaft 105 and the second shaft 115 in the same direction at the same rotational speed will produce the desired orbital motion between the workpiece 10 and the conjugate form 20.

Figure 5:
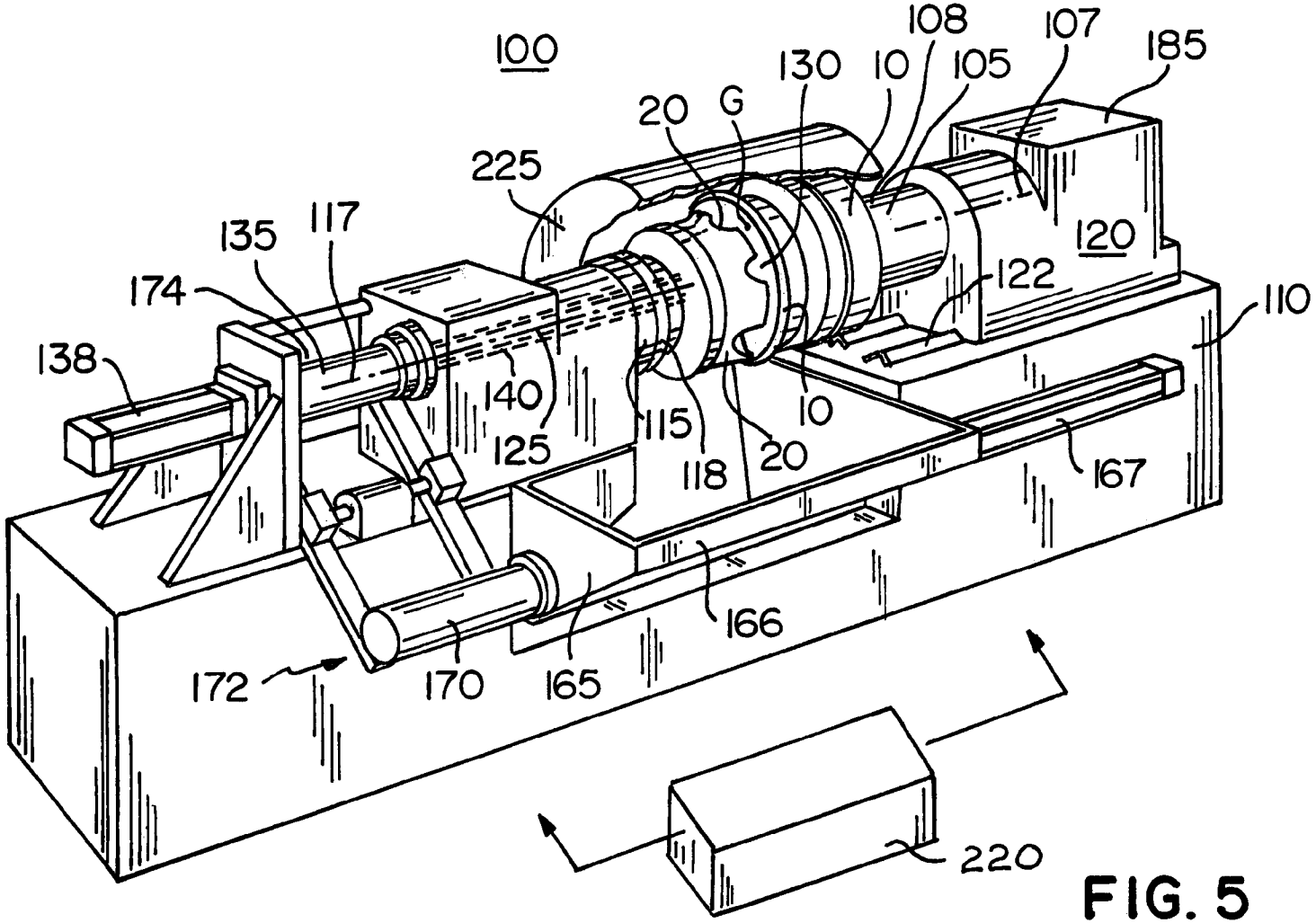
FIG. 5 is a perspective view illustrating the concept of one embodiment of the apparatus in accordance with the subject invention.
Figure 6:
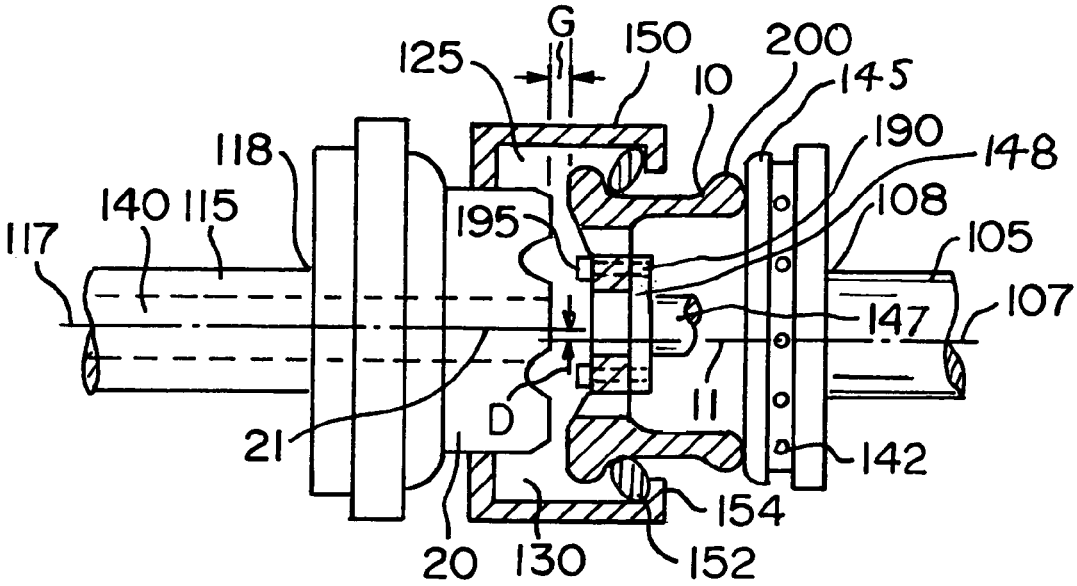
FIG. 6 is side view of a portion of the assembly illustrated in FIG. 5.

FIG. 5 illustrates an apparatus 100 utilizing this principal to polish the workpiece 10 using the conjugate form 20. FIG. 6 shows details of a portion of this apparatus 100. The abrasive flow apparatus 100 includes a first shaft 105 secured to a base 110. The first shaft 105 is rotatable about a first longitudinal axis 107 having a first end 108, wherein the first end 108 is adapted to receive the workpiece 10 having a centerline 11. The apparatus 100 further includes a second shaft 115 secured to the base 110. The second shaft 115 is rotatable about a second longitudinal axis 117. The second shaft 115 also has a first end 118, wherein the first end is adapted to receive the conjugate form 20 of the workpiece 10. Additionally, the conjugate form 20 has a centerline 21. The first ends 108, 118 of the shafts 105, 115, are facing one another such that the workpiece 10 and the conjugate form 20 are also facing one another. As illustrated in FIG. 6 the centerline 11 of the workpiece 10 and the centerline 21 of the conjugate form 20 are displaced from one another to define an offset D.

Directing attention to FIG. 5, a slide 120 which may be comprised of rollers movable upon bedrails 122 to axially position the first shaft 105 a predetermined distance from the second shaft 115 such that the workpiece 10 on the first shaft 105 may be positioned adjacent to the conjugate form 20 on the second shaft 115 with a gap G defined therebetween, as illustrated again in FIGS. 5 and 6. The gap G between the workpiece 10 and the conjugate form 20 is typically between 1/64-1/2 inch and, preferably, between 1/32 and 1/8 inch. The appropriate gap G may be established by monitoring and evaluating the relative locations of the shafts 105, 115 and the torque of the motors providing the relative rotation between the shafts 105, 115.

To polish the workpiece 10, it is necessary to introduce a flowable abrasive media 125 between the conjugate form 20 and the workpiece 10 within the gap G as shown in FIG. 6.

In order to provide the abrasive flowable media 125 in the region of the gap G identified as the work zone 130, a feeder 135 is utilized. A number of different designs for such a feeder 135 and for a device to supply media to the feeder 135 are possible and such designs are known to those skilled in the art of abrasive flow machining. One such design will be discussed herein. Directing attention to FIGS. 5 and 6, the feeder 135 may be comprised of an advancing mechanism 138, such as a hydraulic cylinder and piston capable of advancing flowable abrasive media 125 through a passageway or tube 140 extending through the second shaft 115 and into the work zone 130. A continuous flow of flowable abrasive media 125 is desired within the work zone 130 to maintain a high quality of flowable abrasive media 125 acting upon the workpiece 10. For that reason, the media 125 resides within the work zone 130 and then is discharged. Such a discharge may occur through passageways 142 (FIG. 6) associated with an intermediate adapter 145 between the first shaft 105 and the workpiece 10.

Directing attention to FIG. 6, it is important to direct flowable abrasive media 125 into the work zone 130 and to retain the flowable abrasive media 125 within the work zone 130 for the appropriate amount of time. To accomplish this, the apparatus 100 further includes an enclosure 150 which completely surrounds the workpiece 10 and the conjugate form 20 to contain the media 125. When the shaft 105 with the workpiece 10 and the shaft 115 with the conjugate form 20 move in an eccentric fashion relative to one another, the enclosure 150, if it connects the workpiece 10 and the conjugate form 20, must have some flexibility. Under these circumstances, the enclosure 150 is secured on one side to the conjugate form 20 and on the other side is sealed against the workpiece 10 through a flexible seal 152 retained against the workpiece 10 by an overhanging lip 154 of the enclosure 150. Although not illustrated, it should be appreciated by one skilled in the art that the enclosure may be comprised of two semi-circles hinged together at one side and bolted together on the opposing side to secure the enclosure 150 around the work zone 130. In this fashion, the resiliency of the flexible seal 152 would accommodate the eccentric relative motion produced by the offset D between the workpiece 10 and the conjugate form 20.

In the alternative, when the first shaft 105 and the second shaft 115 are co-axial with one another, but the workpiece 10 and the conjugate form 20 are offset relative to one another, it may be possible to provide a full rigid enclosure secured to both the first shaft 105 and the second shaft 115 which would be unaffected by the relative eccentric motion between the workpiece 10 and the conjugate form 20. In light of the design herein described for a flexible enclosure 150, details for this rigid enclosure should be known to one skilled in the art of abrasive flow machining.

As previously mentioned, it is preferred to maintain a continuous flow of flowable abrasive media 125 through the work zone 130. To accomplish that, the media 125 travels from the workpiece zone 130 through the passageways 142 within an end piece 145 mounted upon the shaft 105. The media 125 is deposited within a media hopper 165. Directing attention to FIGS. 5 and 6, the media hopper 165 may be comprised of a trough 166 situated beneath the passageways 142 of the end piece 145 such that media 125 exiting the passageways 142 will fall within and be contained by the hopper 165. At such time a sufficient volume of media 125 has accumulated within the hopper 165, a media pusher 167 is advanced against the media 125 to load a supply cartridge 170 which may be indexed from a first position 172, for changing the supply cartridge, to a second position 174 in alignment with passageway 140 to be acted upon by the advancing mechanism 138, thereby discharging media 125 from the cartridge 170 within the passageway 140 and into the work zone 130. The supply cartridge 170 may be pivotally moved from the first position 172 to the second position 174, or may be physically removed and repositioned between the first piston 172 and the second position 174. As a result, the media 125 is recirculated from the hopper 165 to the supply cartridge 170 and using the advancing mechanism 138 through the passage 140 within the second shaft 115 to the workpiece 10 and then through the passageway 142 within the first shaft 105.

While one method for conveying flowable abrasive media 125 from the passageways 142 to the work zone 130 has been described, one skilled in the art of abrasive flow machining would be aware of this and other methods to accomplish the same task.

The first shaft 105 and the second shaft 115 may be rotated by a driver 185 common to both shafts or two drivers with each dedicated to a single shaft. In particular, a driver 185, which may be mechanically operated or hydraulically operated, is used to rotate the first shaft 105 and the second shaft 115 simultaneously such that their first ends 108, 118 are rotating in the same direction. The driver typically rotates the first shaft 105 and the second shaft 115 together at a speed between approximately 100 and 2,000 revolutions per minute and, preferably, between 800 and 1,200 revolutions per minute.

Figure 7:
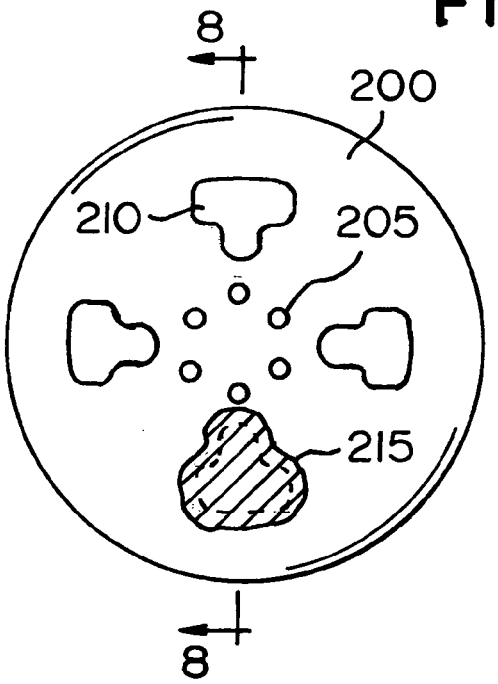
FIG. 7 is a front view of a typical vehicle wheel that may be polished using the apparatus and method in accordance with the subject invention.
Figure 8:
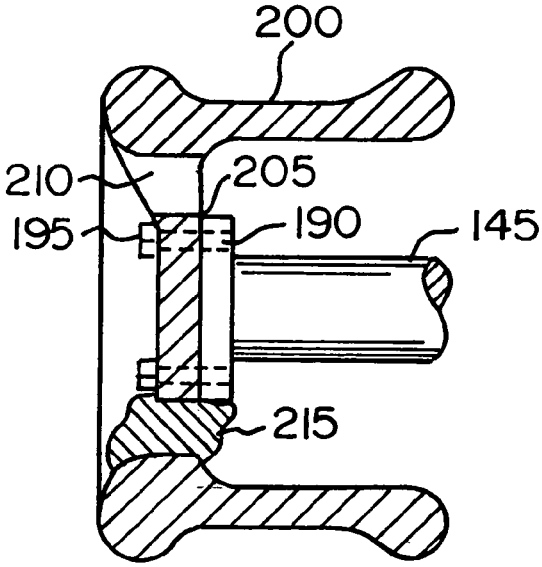
FIG. 8 is a sectional view along arrows "8-8" in FIG. 7 mounted within the assembly illustrated in FIG. 5.

Directing attention to FIGS. 6-8, in one embodiment of the subject invention, the workpiece 10 is a motor vehicle wheel 200. An adapter 147 extends from the end piece 145 and has a flange 148 with threaded holes 190 therein to accommodate bolts 195 extending from lug holes 205 within the wheel 200. Wheels can be held via existing lug holes or by clamping on the OD of the wheel below the bead seat. In certain situations, the fanciful design of the wheel 200 may include an abundance of apertures 210 extending therethrough such that proper control of the flowable abrasive media past the wheel 200 may be compromised. Under such situations, it is entirely possible to provide aperture plugs 215 within selected apertures 210 to either effectively reduce the size of the aperture 210 or to completely block apertures 210 and eliminate the media flow through the aperture 210.

It is possible for the apparatus illustrated in FIG. 5 to be custom fabricated for the specific purposes stated herein, or it is possible to modify existing equipment, such as a commercial lathe, to provide the features described herein.

While as illustrated in FIG. 5, the first shaft 105 and the second shaft 115 are in a horizontal orientation, under other circumstances, it may be desirable that the first shaft 105 and the second shaft 115 be oriented in a non-horizontal orientation, such as a vertical orientation.

Returning attention to FIG. 5, the apparatus 100 furthermore includes a controller 220 to control the speed of rotation imparted by the driver 185. The controller 220 may be implemented using separate electronic assemblies, such as Modicon Model 3200 motion controller or Delta Tau PMAC PC-based motion controller, capable of controlling multiple drivers or controlling a single driver 185 through the use of a single drive control assembly which is mechanically linked to both the first shaft 105 and the second shaft 115. When the polishing operation is completed, the controller 220 stops the relative rotation of the first shaft 105 and second shaft 115 and the enclosure 150 is moved to the open position. Using the bed rails 122, the first shaft 105 is moved to allow for the removal of the workpiece 10 from the first shaft 105 and the insertion of a new workpiece for polishing. The controller 220 will control the rotational speed/orientation and the horizontal feed axis. For the rotational control, if the two spindles are electronically "linked," the controller will regulate the speed of both spindles and will synchronize the radial position of the two spindles with reference to the encoder or resolver on the spindle drive motor. If the two rotational spindles are mechanically linked, the controller will maintain rotational velocity. For the horizontal feed axis, the controller 220 will regulate the in-feed speed and may adaptively control the in-feed speed, based on input from the process, such as torque demands on the rotational axes, etc. The polishing process may continue until the workpiece 10 has been polished a predetermined amount, which may be determined by the amount of media supplied to the workpiece, the number of minutes the workpiece is subjected to polishing the length G of the gap or any combination of these parameters.

As a safety measure, a hood 225 may be used to cover the workpiece 10 and the conjugate form 20 during the machining operation.

While the workpiece 10 has been discussed and illustrated as a motor vehicle wheel, it should be appreciated that the apparatus and method described herein may also be applied to other workpieces, such as a turbine disk, and the scope of the subject invention should not be limited thereto.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. An abrasive flow apparatus for polishing a three-dimensional workpiece having at least one aperture extending therethrough, wherein the apparatus is comprised of:

a) a first shaft secured to a base, rotatable about a first longitudinal axis and having a first end, wherein the first end is adapted to receive a workpiece having a centerline;

b) a second shaft secured to the base, rotatable about a second longitudinal axis and having a first end, wherein the first end is adapted to receive a three-dimensional conjugate form of the workpiece, wherein the conjugate form has a centerline, and wherein the first ends of the shafts are facing one another such that the workpiece and conjugate form are facing one another, c) wherein the centerline of the workpiece and the centerline of the conjugal form are displaced from one another to define an offset;

d) a slide for axially positioning the first shaft and the second shaft a predetermined distance from one another such that the workpiece on the first shaft may be positioned adjacent to the conjugate form on the second shaft with a gap defined therebetween;

e) a feeder for introducing flowable visco-elastic abrasive media upstream of the workpiece within a work zone defined by the volume of the gap between the workpiece and the conjugal form;

f) a discharge passageway downstream of the workpiece for receiving media passing through the at least one aperture; and g) a driver for rotating the first shaft and the second shaft simultaneously such that their first ends are rotating in the same direction and wherein the offset between the two shafts creates relative motion and maintains a gap between the workpiece and conjugate form in three-dimensions such that the flowable abrasive media is urged against the workpiece by the conjugate form.

2. The apparatus according to claim 1, wherein the first shaft and the second shaft are shifted such that their respective longitudinal axes define the offset between the centerlines of the workpiece and the conjugal part.

3. The apparatus according to claim 2, wherein the workpiece and the conjugate form are offset by a distance between 0.5 and 5.0 millimeters.

4. The apparatus according to claim 1, further including an enclosure around the workpiece and the conjugate form to contain the media as it acts upon the workpiece.

5. The apparatus according to claim 1, wherein the enclosure has a flexible portion to accommodate the eccentric relative motion between the workpiece and the conjugate form.

6. The apparatus according to claim 1, wherein the first shaft and the second shaft are co-axial with one another and wherein at least one of the workpiece and the conjugate form are mounted upon their respective shafts in a fashion such that their respective centerlines are offset relative to one another.

7. The apparatus according to claim 1, further including an enclosure around the workpiece and the conjugate form to contain the media as it acts upon the workpiece.

8. The apparatus according to claim 1, wherein the feeder comprises a passageway extending through the second shaft and into the work zone.

9. The apparatus according to claim 8, further including a media recirculating device for recirculating media from the discharge to the feeder.

10. The apparatus according to claim 1, wherein the workpiece is a motor vehicle wheel.

11. The apparatus according to claim 10, further including an adapter mounted upon the first end of the first shaft and wherein the adapter has a flange with threaded holes therein to accommodate bolts extending from wheel lug holes of a wheel to be mounted.

12. The apparatus according to claim 11, further including plugs mounted within certain apertures extending through the wheel for reducing the aperture size within the wheel.

13. The apparatus according to claim 1, wherein the workpiece may be comprised of a turbine disk.

14. The apparatus according to claim 1, wherein the first shaft, the second shaft and the base are part of a lathe.

15. The apparatus according to claim 1, wherein the first shaft and the second shaft are both oriented horizontally.

16. The apparatus according to claim 1, wherein the work zone is further defined by a seal adapted to surround the periphery of the workpiece such that the only media flow is from the feeder through the at least one aperture and into the discharge passageway.

17. An apparatus for polishing a three-dimensional workpiece with flowable abrasive media, wherein the apparatus is comprised of:

a) a first shaft secured to a base, rotatable about a first longitudinal axis and having a first end, wherein the first end has mounted thereupon a workpiece having a centerline;

b) a second shaft secured to the base, rotatable about a second longitudinal axis and having a first end, wherein the first end has mounted thereupon a three-dimensional conjugate form of the workpiece, wherein the conjugate form has a centerline, and wherein the first ends of the shafts are facing one another such that the workpiece and conjugate form are facing one another, c) wherein the centerline of the workpiece and the centerline of the conjugal form are displaced from one another to define an offset;

d) a slide for axially positioning the first shaft and the second shaft a predetermined distance from one another such that the workpiece on the first shaft may be positioned adjacent to the conjugate form on the second shaft with a gap defined therebetween;

e) a feeder for introducing flowable abrasive media within a work zone defined by the volume of the gap between the workpiece and the conjugal form; and g) a driver for rotating the first shaft and the second shaft simultaneously such that their first ends are rotating in the same direction and wherein the offset between the two shafts creates relative motion and maintains a gap between the workpiece and conjugate form in three-dimensions to urge the flowable abrasive media against the workpiece by the conjugate form.

18. A method for polishing workpieces comprising the steps of:

a) mounting a workpiece upon a first end of a first shaft on a horizontal lathe, wherein the first shaft has a longitudinal axis;

b) mounting a conjugate form to the workpiece upon a first end of a second shaft on the horizontal lathe, wherein the second shaft has a horizontal axis and opposes the first shaft;

c) positioning the workpiece and the conjugate form relative to and facing one another such that a small gap exists between them;

d) introducing abrasive flowable media within the gap between the workpiece and the conjugate form; and e) imparting cyclical offset relative motion between the workpiece and the conjugate form such that the abrasive flowable media is urged by the conjugate form against the workpiece, thereby polishing the workpiece.

19. The method according to claim 18, wherein the step of imparting cyclical relative motion comprises the step of positioning the first shaft and the second shaft relative to one another to define an offset between the longitudinal axes of the respective shafts.

20. The method according to claim 18, wherein the step of imparting cyclical relative motion comprises the step of mounting one or both of the workpiece and conjugate form on their respective shafts such that the workpiece and conjugate form are offset relative to one another.

* * * * *